US005457887A

United States Patent [19]

Grange

[11] Patent Number: 5,457,887

[45] Date of Patent: Oct. 17, 1995

[54] HOLDER FOR WET SHAVER

[75] Inventor: Kenneth Grange, London, Great Britain

[73] Assignee: Warner-Lambert Company, Morris Plains, N.J.

[21] Appl. No.: 192,113

[22] Filed: Feb. 4, 1994

[30] Foreign Application Priority Data

Feb. 5, 1993 [DE] Germany ..... 9301570 U

[51] Int. Cl.[6] ..... B26B 21/40

[52] U.S. Cl. ..... 30/90; 30/34.05; D9/342

[58] Field of Search ..... 30/90, 34.05, 298.4; D9/342; D28/45–48, 52–I54, 73; D6/526; 206/208, 228, 349; 132/289; 211/70.7, 70.6

[56] References Cited

U.S. PATENT DOCUMENTS

D. 227,232 6/1973 Glaberson et al. ..... D9/342

2,702,116 2/1955 Shnitzler et al. .

FOREIGN PATENT DOCUMENTS 0483481 5/1992 European Pat. Off. .

9014878 10/1990 Germany .

222597 10/1942 Switzerland .

*Primary Examiner*—Douglas D. Watts

*Attorney, Agent, or Firm*—Robert W. Becker & Associates

[57] ABSTRACT

A holder for a wet shaver has a body having a planar bottom and an upper side with a substantially half shell contour. The upper side has at least one depression for receiving a wet shaver. The depression has a contour and a depth such that a wet shaver received in the depression substantially complements the half shell contour of the upper side.

20 Claims, 2 Drawing Sheets

HOLDER FOR WET SHAVER

BACKGROUND OF THE INVENTION

The present invention relates to a holder for a wet shaver, especially a holder for wet shavers that serves at the same time for receiving the wet shaver for packaging and distribution purposes as well as a stand for the wet shaver for the user.

Holders for wet shavers are known in the prior art.

For example, German Gebrauchsmuster 90 14 878 discloses a holder for the combined securing of a wet shaver and a dispenser for razor blade units.

Such holders are used in order to safely store wet shavers so as to prevent injury, and at the same time, to provide a dispenser for razor blade units essentially in the vicinity of the wet shaver. For this purpose, the known wet shaver has a base at which a support device for suspending the wet shaver as well as a receiving device for holding a box-shaped dispenser are arranged, the receiving device being in the form of a slot-like recess at the base for inserting the dispenser.

On the one hand, such known holders require a considerable expenditure for their manufacture because they are comprised of a plurality of parts which must be manufactured separately and subsequently assembled. Furthermore, the known holders have a design that is controlled only by functional aspects and they cannot be improved on with respect to their design, for example, for improving the integration of a wet shaver/holder into the bathroom environment. Due to the lack of solely visual design opportunities with respect to the holder geometry, the holder cannot be further developed for sale-increasing purposes.

It is therefore an object of the present invention to provide a holder for a wet shaver which, based on the premise of maintaining the possibility of securely storing the wet shaver, should be producible in an economical manner and, at the same time, provide the possibility to design the holder with regard to visual aspects.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
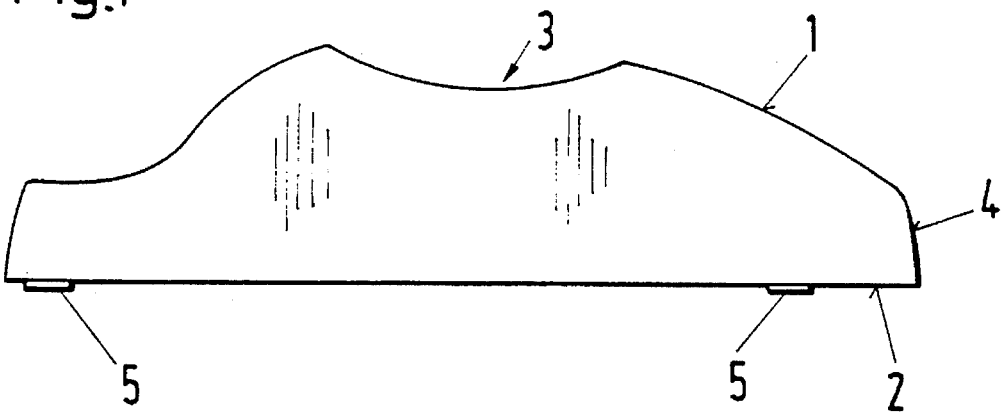
FIG. 1 shows an embodiment of an inventive holder in a side view.

The inventive holder for a wet shaver according to the present invention is primarily characterized by:

A body having a planar bottom and an upper side with a substantially half shell contour;

The upper side having at least one depression for receiving a wet shaver; and

The depression having a contour and a depth such that a wet shaver received in the depression substantially complements the half shell contour.

Preferably, the depression has a widened portion in an area where a grip of the wet shaver is received.

Preferably, the holder further comprises bores for connecting the holder to a wall, the bores provided within the depression.

Advantageously, in an area where a razor blade unit of the wet shaver is received, the half shell contour is discontinued above the depression.

In a preferred embodiment of the present invention, the wet shaver is held in a form-locking manner in the holder.

Expediently, the holder further comprises an additional securing element for the wet shaver.

Preferably, the bottom has legs and also a recess for receiving a razor blade dispenser.

Advantageously, the holder is made of plastic material. Expediently, the holder and wet shaver have matching colors.

The present invention is concerned with a combination of a holder and a wet shaver that is primarily characterized by:

A holder in the form of a body having a planar bottom and an upper side with a substantially half shell contour;

The upper side having at least one depression;

A wet shaver received in the depression; and

The depression having a contour and a depth such that the wet shaver received in the depression substantially compliments the half shell contour.

Preferably, the wet shaver has a grip and the depression has a widened portion where the grip is positioned in the holder.

Advantageously, the body further comprises bores for connecting the holder to a wall, the bores provided within the depression. Advantageously, the wet shaver has a razor blade unit and, in an area of the holder where the razor blade unit is received, the half shell contour is discontinued above the depression.

Expediently, the wet shaver is connected to the holder in a form-locking manner.

Advantageously, the holder further comprises an additional securing element for the wet shaver.

In a preferred embodiment of the present invention, the bottom has legs and further a recess for receiving a razor blade dispenser.

Preferably, the holder is made of plastic. Advantageously, the holder and the wet shaver have matching colors.

The technical solution according to the present invention suggest a holder for a wet shaver which is in the form of a body the flat surface of which forms a bottom, whereby the upper side has depressions for inserting the wet shaver which depressions with respect to contour and depth are embodied such that the half shell outer contour of the upper side is substantially complemented by the inserted wet shaver.

The inventive holder can be manufactured as a unitary part which provides for an essentially an economical manufacturing process. Furthermore, the inventive holder is extremely variable with respect to its geometric shape as long as the shape allows for the integration of the wet shaver with respect to its outer contour. The combination of holder and wet shaver provides for a geometric unit with respect to the shape. Of course, this can be visually enhanced by a corresponding coloring.

The peripheral contour of the depression corresponds substantially to the vertical projection of the contour lines of the wet shaver to be received in the holder so that the wet shaver essentially fits with its outer contour in a form-locking manner into the depressions. With respect to the depth, the depressions are adapted to the lower outer contour of the wet shaver so that the wet shaver can only be inserted into the holder up to a defined depth. The contour area of the wet shaver projecting upwardly past the depressions substantially complement the outer contour and shape of the upper side of the holder so that a geometric unit is provided.

The inventive holder, respectively, the combination wet shaver/holder can now be adapted with respect to color and shape to modern bathroom furnishings. Furthermore, the holder can be provided with respective bores for connecting the holder to a wall.

It is furthermore advantageous that in the area of the holder in which the grip of the wet shaver is received the depressions are widened. This provides for a gripping area so that the wet shaver in the area of the grip can be easily gripped by the user.

It is furthermore advantageous that above the depressions for the razor blade unit of the wet shaver, the half shell contour is not continued. Essentially, the razor blade unit of a wet shaver is arranged at a bent head portion which itself is provided with a smooth outer contour for complementing the half shell contour of the upper side. Thereabove, the upper side can be adapted to the shape of the underside in a flat contour. The resulting surface may be used for lettering.

It is expedient that the wet shaver be held within the holder by form-locking. With corresponding narrow tolerances in the design of the depressions, the wet shaver can be inserted into the holder in such a tight manner that it is held therein by form-locking. In the alternative, an additional securing element, for example, magnets etc., may be provided for securing the wet shaver. This is beneficial for a wall mounting of the holder.

It is furthermore advantageous that the planar bottom of the holder is provided with legs. This is favorable with respect to the use of the holder/wet shaver unit in the vicinity of a lavatory because the holder cannot become wet at the bottom.

It is furthermore expedient that the bottom of the holder is provided with a recess for receiving a dispenser for razor blade units. With this measure the holder is further developed as a combined receiving unit for a razor blade dispenser and the wet shaver.

Preferably, the inventive holder is produced as a unitary part from plastic material and can be adapted with respect to its color to the color of the wet shaver. Thus, the combination wet shaver/holder can be designed in a more attractive appearance for improving sales and is also more variable with respect to its integration into the bathroom environment.

DESCRIPTION OF PREFERRED EMBODIMENTS

The present invention will now be described in detail with the aid of several specific embodiments utilizing FIGS. 1 through 5.

FIG. 1 shows a holder for a wet shaver that has a substantially planar bottom 2 which in the shown embodiment is essentially elliptical. The shape of this bottom side however can be circular or angular.

The upper side 1 of the holder has a half-shell contour and corresponds in the shape of the planar underside. This means that for an essentially elliptical bottom the upper side has the shape of a semi ellipsoid. A holder with a circular bottom thus has the shape of a semisphere.

The upper side 1 is provided with depressions 3 which, with respect to their contour and depth, correspond to the shape of the wet shaver to be inserted therein.

Figure 2:
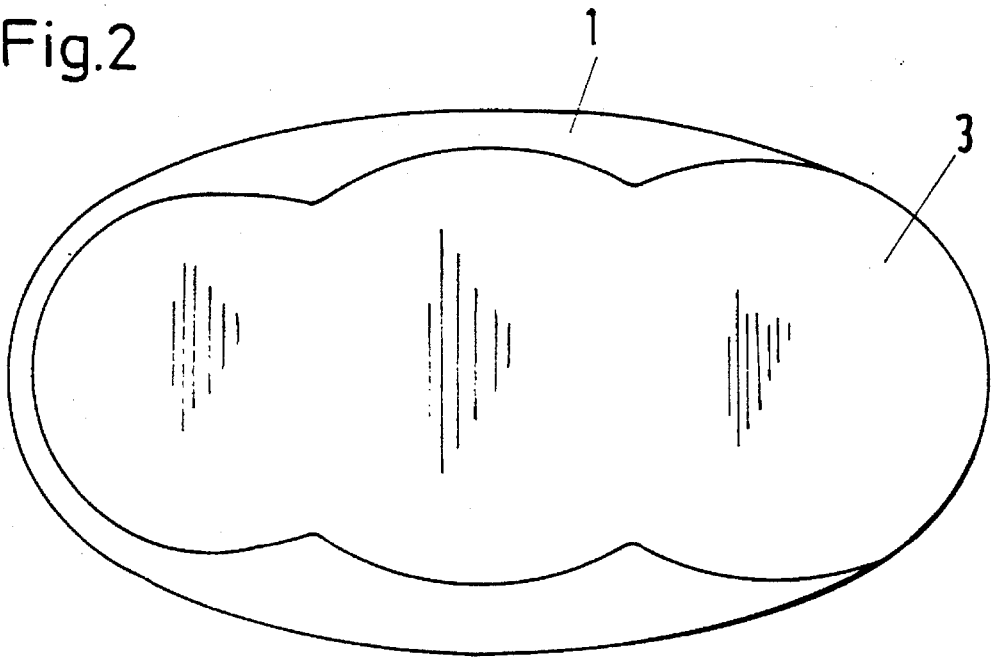
FIG. 2 shows a top view of the holder of FIG. 1.

At the forward portion 4 the half shell contour is not continued. In FIG. 2 the periphery of the depressions 3 is shown in a top view.

Figure 3:
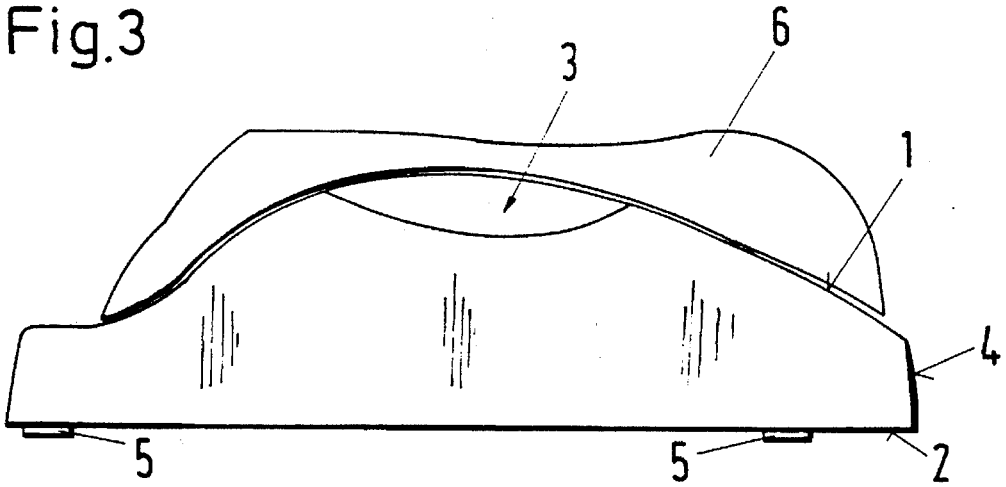
FIG. 3 shows a side view of the holder of FIG. 1 with an inserted wet shaver.

As can be seen in FIG. 3, the wet shaver 6 is inserted into the holder so that the outer contour of the upper side 1 is essentially complemented. The wet shaver 6 fits almost exactly into the depressions 3 in a form-locking manner. In the area of the razor blade unit the wet shaver 6 has a bent razor blade holder which forms the end of the contour so that in the area 4 the half shell contour is discontinued.

Figure 4:
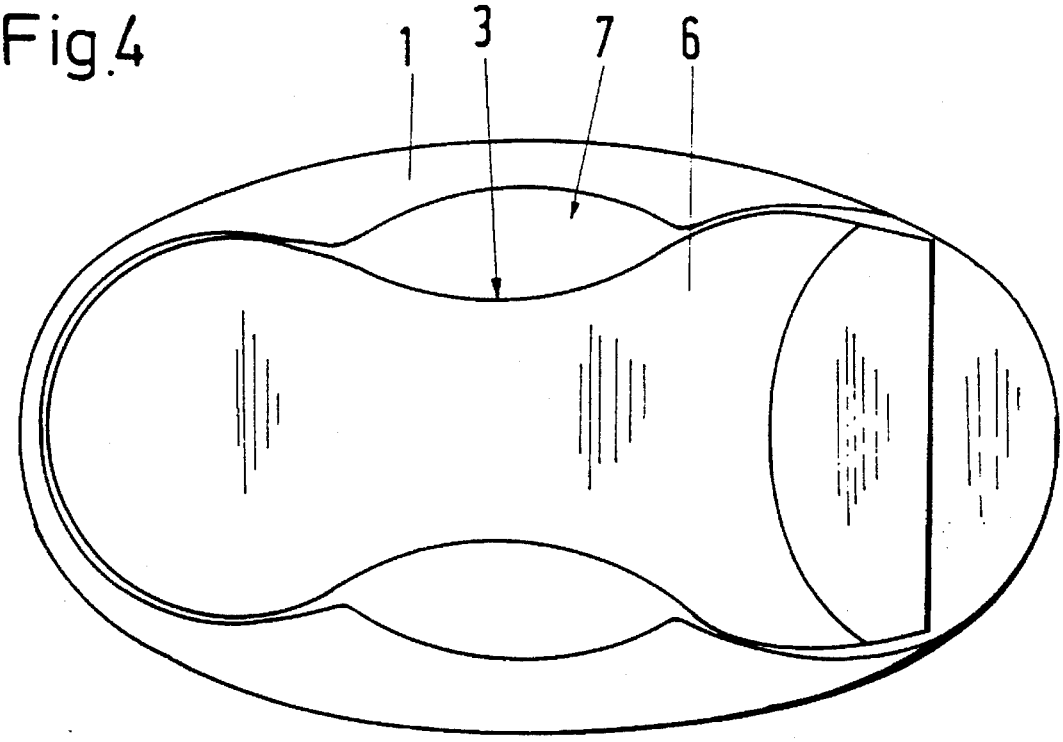
FIG. 4 shows a top view of FIG. 3.

As can be seen in FIG. 4, in the area of the grip of the inserted wet shaver the depressions are widened so that a gripping depression 7 results.

Figure 5:
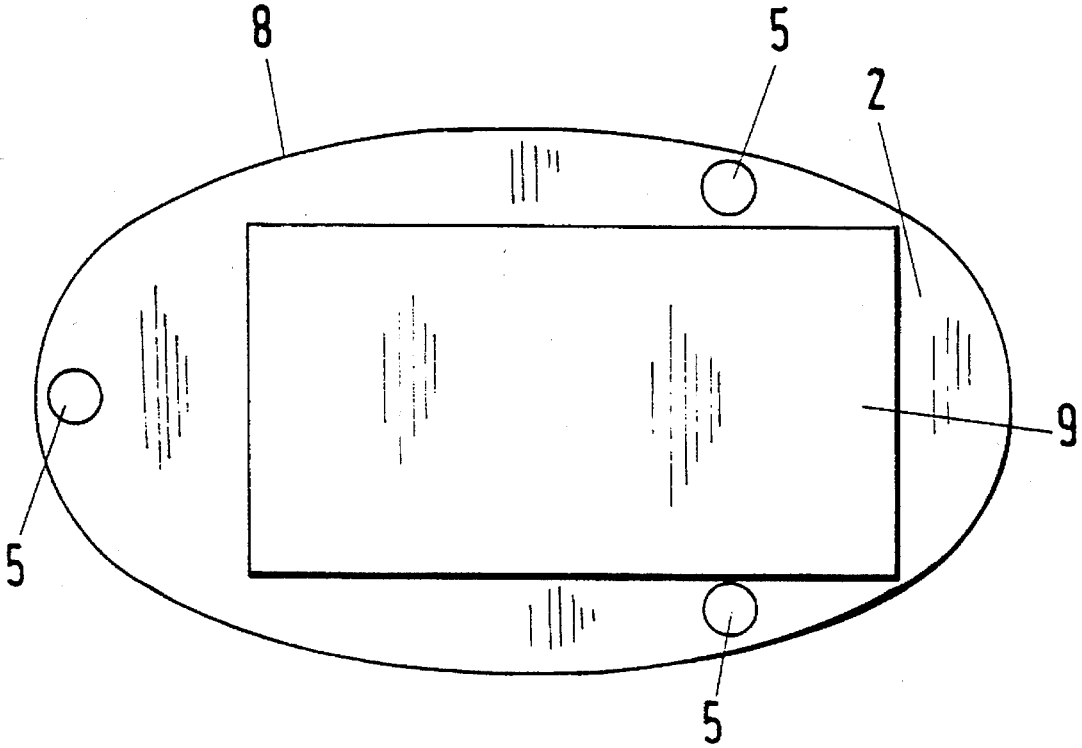
FIG. 5 shows a bottom view of the holder of FIG. 1.

According to FIG. 5 the planar bottom 2 has an elliptical contour 8. Legs 5 are arranged at the bottom. Furthermore, a rectangular recess 9 for a dispenser for razor blade units is provided. Such a razor blade dispenser can be provided in an advantageous manner with a pivotable lid so that it must not be removed from the holder for replacing a razor blade unit.

The present invention is, of course, in no way restricted to the specific disclosure of the specification and drawings, but also encompasses any modifications within the scope of the appended claims.

What I claim is:

1. A holder for a wet shaver comprising:

a unitary body in the shape of a semi-ellipsoid having been cut in half along the longitudinal axis of the ellipsoid, said body having a planar bottom and an upper ellipsoidally curved side having at least one depression for receiving a wet shaver; and said depression having a contour and a depth such that a wet shaver received in said depression substantially complements said upper ellipsoidally curved side.

2. A holder according to claim 1, wherein said depression has a widened portion in an area where a grip of the wet shaver is received.

3. A holder according to claim 1, further comprising bores for connecting said holder to a wall, said bores provided within said depression.

4. A holder according to claim 1, wherein in an area of said depression, where a razor blade unit of the wet shaver is received, said upper ellipsoidally curved side is not complemented.

5. A holder according to claim 1, wherein the wet shaver is held in a form-locking manner in said holder.

6. A holder according to claim 1, further comprising an additional securing element for the wet shaver.

7. A holder according to claim 1, wherein said bottom has legs.

8. A holder according to claim 1, wherein said bottom has a recess for receiving a razor blade dispenser.

9. A holder according to claim 1, wherein said holder is made of plastic material.

10. A holder according to claim 1, wherein said holder and the wet shaver have matching colors.

11. A combination of a holder and a wet shaver, said combination comprising:

a holder in the form of a unitary body in the shape of a semi-ellipsoid having been cut in half along the longitudinal axis of the ellipsoid, said body having a planar bottom and an upper ellipsoidally curved side with a substantially convex half shell contour;

said upper side having at least one depression;

a wet shaver received in said depression; and said depression having a contour and a depth such that said wet shaver received in said depression substantially complements said upper ellipsoidally curved side.

12. A combination according to claim 11, wherein said wet shaver has a grip and wherein said depression has a widened portion where said grip is positioned in said holder.

13. A combination according to claim 11, wherein said body further comprises bores for connecting said holder to a wall, said bores provided within said depression.

14. A combination according to claim 11, wherein said wet shaver has a razor blade unit and wherein said wet shaver in the area of said razor blade unit is shaped so as not to complement said upper ellipsoidally curved side.

15. A combination according to claim 11, wherein said wet shaver is connected to said holder in a form-locking manner.

16. A combination according to claim 11, wherein said holder further comprises an additional securing element for the wet shaver.

17. A combination according to claim 11, wherein said bottom has legs.

18. A combination according to claim 11, wherein said bottom has a recess for receiving a razor blade dispenser.

19. A combination according to claim 11, wherein said holder is made of plastic material.

20. A combination according to claim 11, wherein said holder and said wet shaver have matching colors.

* * * * *